United States Patent [19]

Houlihan

[11] 4,390,289

[45] Jun. 28, 1983

[54] TIMEPIECE WITH MULTIFUNCTIONAL MEMBER

[75] Inventor: John T. Houlihan, Watertown, Conn.

[73] Assignee: Timex Corporation, Waterbury, Conn.

[21] Appl. No.: 292,756

[22] Filed: Aug. 14, 1981

[51] Int. Cl.[3] ..... G04B 37/00

[52] U.S. Cl. ..... 368/286; 368/316

[58] Field of Search ..... 368/88, 276, 286, 316–317; D10/15, 18; D18/7

[56] References Cited

U.S. PATENT DOCUMENTS

| | | | |
|---|---|---|---|
| D. 249,822 | 10/1978 | Ohie et al. | D18/7 |
| D. 255,433 | 6/1980 | Anderson et al. | D10/15 |
| D. 255,996 | 7/1980 | Tamura | D10/15 |
| D. 258,221 | 2/1981 | Shimasaki | D18/7 |
| 900,317 | 10/1908 | Slattery | 368/316 |
| 2,567,564 | 9/1951 | Ingraham | 368/316 |

FOREIGN PATENT DOCUMENTS 450010 7/1936 United Kingdom .

*Primary Examiner*—Vit W. Miska
*Attorney, Agent, or Firm*—William C. Crutcher

[57] ABSTRACT

A timepiece in the form of a miniature digital clock includes a front side with a window portion to receive a transparent window for viewing time display means disposed inside the clock housing and an actuator-receiving portion adjacent the window portion to receive slide switches, push switches or other switch means to control the functions of the clock. A multifunctional member is pivotably mounted on the housing and includes an open portion and adjacent cover portion. The multifunctional member is pivotable to a first position where the cover portion overlies the actuator means to prevent accidental actuation of the clock actuator means during travel and the open portion overlies the window portion of the clock to permit viewing of the time display means when the actuator means is covered. The member is also pivotable to a second position behind the clock housing such that the member functions as an adjustable stand means for supporting the timepiece on a table or the like.

8 Claims, 10 Drawing Figures

TIMEPIECE WITH MULTIFUNCTIONAL MEMBER

FIELD OF THE INVENTION

The present invention relates to timepiece constructions and, in particular, to a timepiece having a multifunctional member which serves as cover means during carrying to prevent accidental actuation of the clock actuator buttons or switches while permitting viewing of the time display thereof and which also serves as selectable stand means to support the clock on a table or the like at other times.

BACKGROUND OF THE INVENTION

Prior art workers have devised travel clocks having attached covers and/or stands. For example, U.S. Pat. No. De. 255,433 issued June 17, 1980 to Anderson et al illustrates a travel clock having a digital time display on the front side and a pivoting cover/stand member. The cover/stand member can be pivoted in front of the display to completely close off the front side and display from view and also is pivoted behind the clock to serve as a stand to support the clock at a specific viewing angle.

The Tamara U.S. Pat. No. De. 255,996 issued July 22, 1980 discloses a travel clock having a pivotable stand attached to the base of the clock. During travel, the stand is pivoted out of the way into a recess in the base of the clock. At other times, the stand is pivoted out of the recess transverse to the base to support the clock in a generally vertical position for viewing.

U.S. Pat. No. De. 249,822 issued Oct. 3, 1978 to Ohie et al provides a combination calculator/digital clock having a hinged cover with an integral cover window. When the calculator is not being used, the cover is apparently closed with the digital time display being visible through the cover window and the calculator keys protected behind the cover. U.S. Pat. No. De. 258,221 issued Feb. 10, 1981 to Shimasaki provides a combination calculator/digital clock having a similar cover.

There are also known travel clocks having a pivoting stand member mounted on the end of the clock case. During travel the stand member is pivoted into alignment with the end of the clock case, forming in effect an extension thereof. At other times, the stand member is pivoted such that a portion extends behind the clock case at one end to support the clock in a selectable inclined position for viewing.

While travel clocks in the prior art have generally been provided for completely closing them up, it is useful to be able to continue to read the displayed time while in the transport mode. Also, the reduced size of minature digital alarm timepieces of the type which the present invention contemplates are not strictly speaking considered as clocks, but also considered as pocket or purse timepieces as well. Therefore, to continue to read the time quickly when in a transport mode without danger of other objects actuating the timepiece switches or buttons would be a great convenience.

Many prior art timepieces have pushbutton actuator for a repeat alarm feature which is difficult to locate and actuate. Also, as the timepices become very small, there is a problem when pushing the button so that the clock does not move instead.

Accordingly, one object of the present invention is a portable timepiece with protective cover member for the actuators which permits viewing the display with the cover closed, the member also serving other purposes.

Another object of the invention is a portable timepiece with a pivotable stand member, which supports the timepiece in a selectable inclined position for viewing, the member also serving other purposes.

Another object of the invention is to provide an improved timepiece with a pushbutton actuator located in an improved location, which will operate when the timepiece cover is either open or closed.

DRAWINGS

The invention, both as to organization and practice, together with further objects and advantages thereof, will best be understood by reference to the following specification taken in connection with the accompanying drawings in which:

FIG. 1 is a front elevation of the travel clock of the invention, with the multifunctional member pivoted to the second position behind the timepiece, FIG. 2 is a front elevation with the multifunctional member pivoted to the first position in front of the timepiece, FIG. 3 is a right side elevation of FIG. 1, FIG. 4 is a left side elevation of FIG. 2, FIG. 5 is a rear elevation of FIG. 2, FIG. 6 is a front elevation of the molded front housing of the timepiece, FIG. 7 is a front elevation of the molded multifunctional member, FIG. 8 is a right side elevation of FIG. 7, FIG. 9 is a rear view in cross-section through pivot A of FIG. 1 and the adjacent corner of the housing; and FIG. 10 is a rear in cross-section view of pivot B of FIG. 1 and the adjacent corner of the housing.

SUMMARY OF THE INVENTION

Briefly stated, the present invention provides a timepiece construction in which a front side of the timepiece housing includes a window portion for viewing time display means inside the housing and further includes a actuator-receiving portion adjacent the window portion. A transparent window is received in the window portion and first actuator means, such as slide and push switches, are mounted on the housing in the actuator-receiving portion. A multifunctional member is pivotably attached at the top of the timepiece housing and includes an open portion and a cover portion adjacent thereto. The multifunctional member is pivotable to a first position wherein the cover portion overlies the actuator means to prevent accidental actuation during carrying and the window portion overlies the window portion of the front side of the clock housing to still allow viewing of the time display means when the actuator means is covered. The member is also pivotable to a second selectable position behind the clock housing such that the member functions as adjustable stand means for supporting the clock housing.

In the illustrated embodiment, the clock housing has a generally parallel-pipedal shape with an upper window portion and a lower actuator-receiving portion on the front side. Opposite ends of the top of the clock housing transversely oriented to the front side each include a pivot pin projecting therefrom. The multifunctional member includes a pair of spaced leg members each having one end pivotably mounted on a respective pivot pin and having the other end joined to a cover portion, configured to overlap the actuator-receiving portion of the front side of the clock housing when the member is pivoted to the first position described above. The space between the leg members accomodate the window for viewing the time display means when the actuator means is covered.

In the preferred embodiment, second actuator means in the form of a selected pushbutton actuator operating a switch controlling a selected function of the timepiece is mounted in one of the pivot pins of the housing. This location allows a squeezing movement to operate the switch when the timepiece multifunctional member is in either position. On the other pivot pin a frictional screw is threaded into the pivot pin and acts upon a resilient ring disposed between the shaft and leg member pivoted thereon to vary the friction force at the pivot. This feature construction the user of the clock to pivot and manually adjust the multifunctional member at a selected angular position behind the clock housing for the desired viewing angle, with the member functioning as stand means.

DESCRIPTION OF THE PREFERRED EMBODIMENT

Figure 1:
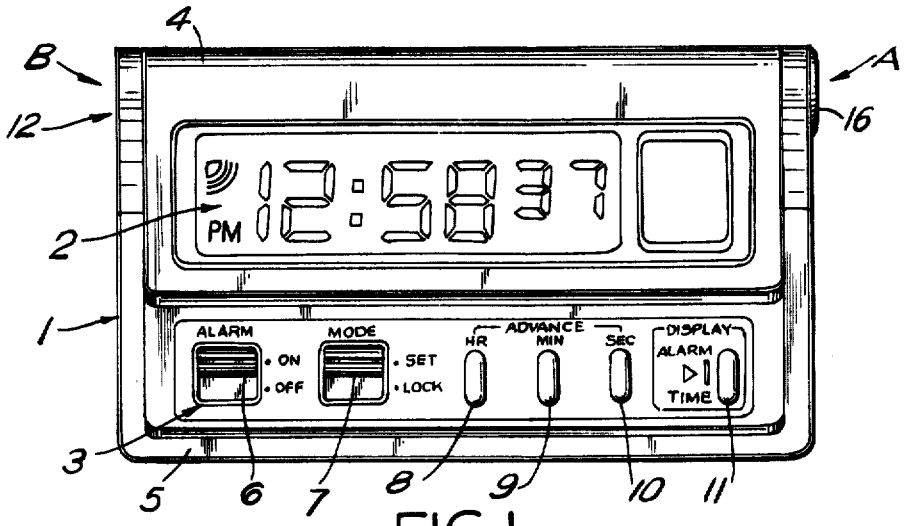

Referring now to FIG. 1 of the drawing, a timepiece shown generally as 1, is shown in an open or "second" position as it would appear when resting on a table or the like and serving as a clock. The front of the timepiece includes a window portion shown generally as 2 and an actuator portion shown generally as 3, both portions formed in the front of a housing 4. A flange 5 extends around the lower side of the back of the housing and partially up the sides thereof. In a manner which is well known in the art and not material to the present invention, the housing contains a timepiece module with a suitable battery power supply actuating the timepiece display to show the time of day, as well as to operate other functions such as an alarm, calender display, etc. The display may be any suitable type such as liquid crystal display. A plurality of actuators 6–11 are located on the actuator portion 3 to perform various essential functions such as turning the timepiece off and on, setting the alarm, setting the time, date, etc. While the actuators should be relatively accessible, inadvertent actuation in a non-prescribed manner is undesirable.

Pivotably mounted on the housing 4 in accordance with the present invention is a multifunctional member 12 disposed to pivot at points designated A and B.

Figure 3:
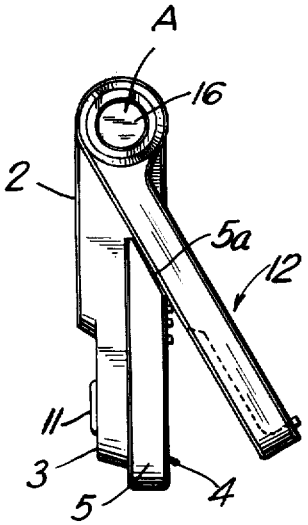

Reference to FIG. 3 of the drawing illustrates the pivotable multifunctional member 12 pivoted to the extremity of the second position with respect to housing 4. There, member 12 abuts an inclined surface 5*a* on the flange 5 serving to limit the extent of travel when member 12 pivots about point A. An actuator button 16 for operating the repeat alarm feature of the timepiece is disposed in the pivot member forming pivot point A.

Figure 2:
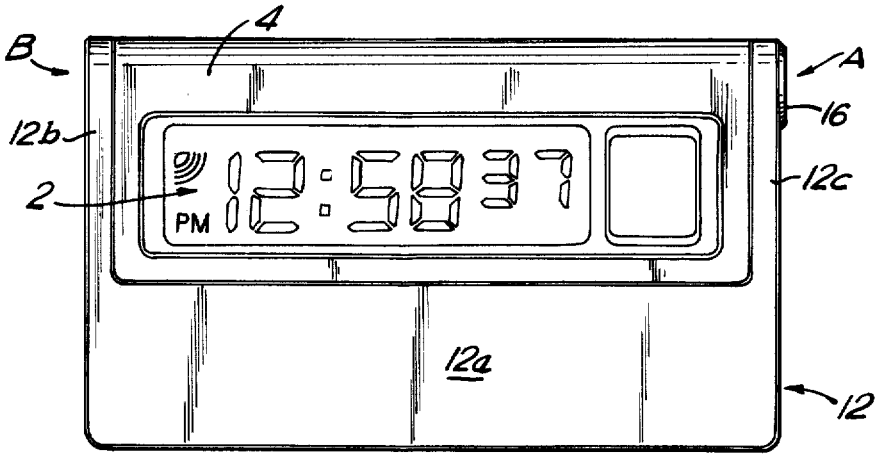

Referring now to FIG. 2 of the drawing which is a front elevation of the timepiece in a closed or "first" position, the window portion 2 covering the display is exposed to view as before. The multifunctional member 12 is shown to include a cover portion 12*a* and first and second spaced 12*b* and 12*c*. The space between the legs accomodates the window portion 2 of the display, while the cover portion 12*a* covers the actuator portion 3 of the housing.

Figure 4:
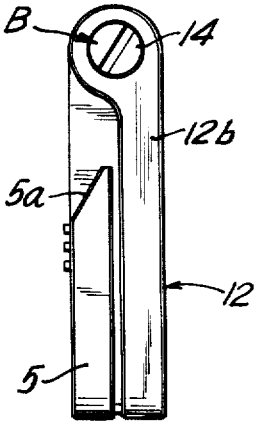

FIG. 4 is a side view of FIG. 2 with the timepiece in the closed position. Pivot point B is seen to include an adjustable screw 14 with a slotted head to adjust the pivot friction.

Figure 5:
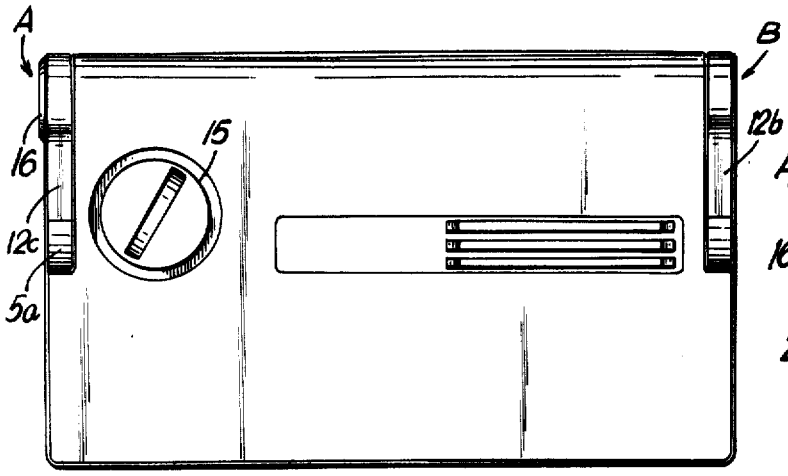

Reference to FIG. 5 shows the back view of the timepiece when in the FIG. 2 or closed position. A conventional battery hatch 15 can be seen as well as the inclined surfaces 5*a* on flange 5.

Figure 6:
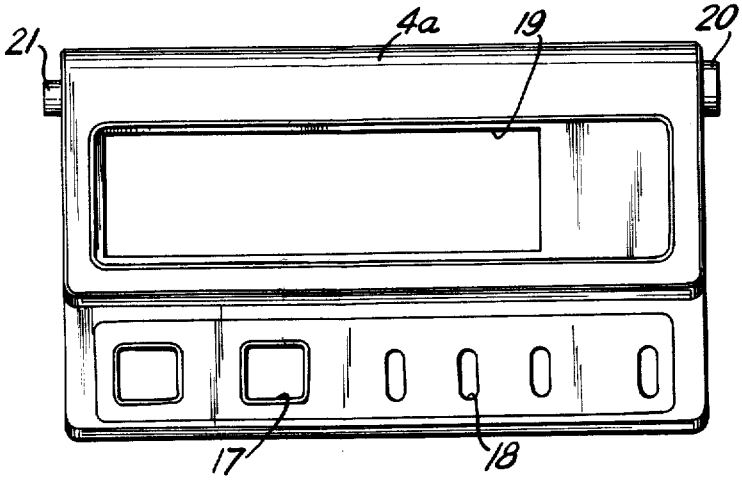

FIG. 6 is an elevation view of the front half 4*a* of the housing without the multifunctional member attached. The housing includes actuator-receiving recesses, such as 17, 18 and a window-receiving recess 19. The back half of the housing (not shown) mates with the front housing half 4*a* and carries the flange 5 discussed previously. Protruding from opposite ends at the top of the housing are cylindrical pivot pins 20,21. These serve as pivot points for the multifunctional member shown in FIG. 7 and 8.

Figure 7:
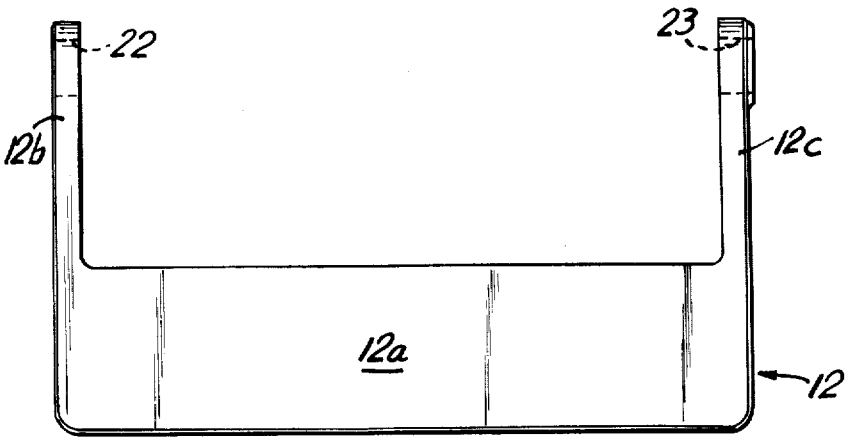
Figure 8:
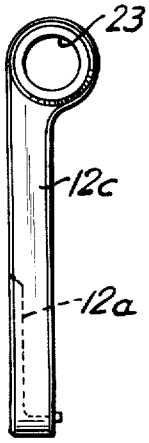

As indicated in FIG. 7, leg 12*b* includes a hole 22 and leg 12*c* includes a hole 23. Hole 23 is slightly larger than pivot pin 20 and fits thereover with a small clearance to allow pivoting. On the other hand, hole 22 is oversized with respect to pivot pin 21 so as to accommodate therebetween a compressible elastomeric washer as will be described. FIG. 8 illustrates further details from the side view of the multifunctional member, showing the cover portion 12*a* in cross-section.

Figure 9:
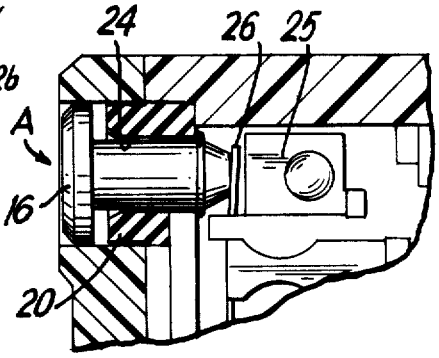

The FIG. 9 cross-section view illustrates the details of the actuator button 16 disposed at pivot point A. The pivot pin 20 has an internal hole 24 to accomodate the actuator button 16 with a sliding movement. Inside the timepiece is a switch 25 which is closed by spring action of a metallic member 26 when pushbutton 16 is depressed. Actuator 16 and switch 25 are connected so that they perform a selected desired function when the multifunctional member is in either the first or second position. In the preferred embodiment, the actuator 16 operates a light and also operates a repeat alarm function which silences the alarm for an interval of time before it repeats.

Figure 10:
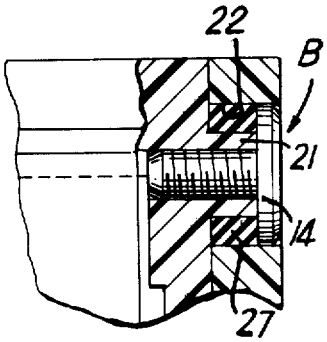

Referring to FIG. 10, at pivot point B, the adjustable pivot construction is shown. An elastomeric washer 27 is interposed between the pivot pin 21 and the hole 22 in the multifunctional member. The screw 14 may be tightened or loosened to squeeze the elastomer 27 and vary the compressive force on the gasket to adjust the friction.

OPERATION

The operation of the invention should be apparent from the foregoing description. Pivoting the multifunctional member 12 to the closed or first position (FIG. 2) places the timepiece in a travel or carrying mode which, permits viewing the timepiece without inadvertent actuation of first actuator means, but which nevertheless permits actuation of selected second actuator means.

Pivoting the multifunctional member to the second position, i.e., rotating it to almost 350° about pivot points A and B, uncovers the first actuating switch members and serves to allow use of the timepiece on a desk or the like. Since the pivot friction may easily be adjusted, the second position may be varied to a selected angle for viewing from a sitting, standing position to provide the best angle. If desired, one or more detents can be added to fix the standing position at certain desirable angles (e.g. 60°). When functioning either as a desk clock or as a portable pocket or purse timepiece, i.e., either in the open or closed position, the actuator button 16 at the pivot point may nevertheless be operated. Due to the small dimensions of the timepiece, the button 16 may be squeezed against the pivot point on the opposite side between the thumb and finger, since the clock is only on the order of 3 inches or so between pivot points A and B. By operating the actuator with a squeezing motion, this permits ease of operation in spite of the small size of the timepiece.

While there has been described herein the preferred embodiment of the invention, it is desired to encompass in the appended claims all such modifications as fall within the true spirit and scope of the invention.

I claim:

1. In a timepiece construction having time display means disposed inside a housing, the combination of:

a housing member having a window portion through which the time display means can be viewed and an actuator-receiving portion adjacent said window portion, first actuator means mounted in the actuator-receiving portion of the housing and connected to control selected functions of the timepiece, and a multifunctional member defining an open portion and a cover portion adjacent thereto, said member being pivotally mounted on the housing and pivotable to a first position in front of the housing such that the cover portion overlies the first actuator means to prevent accidental actuation during carrying and the open portion accomodates the window portion to permit viewing of the time display means while the first actuator means is covered, and pivotable to a second position behind the housing such that said member functions as stand means for supporting the timepiece.

2. The combination according to claim 1, wherein said housing includes a first pivot pin pivotally mounting said multifunctiional member, and adjustable frictional means interposed between the pivot pin and said member for providing selection of viewing angle when the member is in the second position.

3. The combination according to claim 1, wherein said housing includes a second pivot pin pivotably mounting said multifunctional member, and second actuator means disposed in said second pivot pin and connected for actuating selected timepiece functions when the member is in either the first or second position.

4. The combination according to claim 1, wherein said multifunctional member comprises first and second leg members defining said open portion therebetween, and connected by said cover portion, and wherein said housing defines at the top thereof first and second oppositely directed pivot pins receiving said first and second legs, respectively, at the ends thereof.

5. The combination according to claim 4, wherein said housing defines a flange extending around the bottom edge and partially up the sides thereof, and terminating in an inclined surface adapted to limit the pivoting motion of the multifunctional member when contacted by said leg members.

6. The combination according to claim 4, including a compressible elastomeric gasket interposed between one of said pivot pin and the respective leg member of the multifunctional member and having screw adjustment means for varying the compressive force and hence the pivoting function of the multifunctional member.

7. The combination according to claim 4, including second actuator means comrising a push button disposed in one of said pivot pins and a switch inside the housing arranged to operate selected timepiece functions when the push button is depressed.

8. In a timepiece construction having the display means disposed inside a housing, the combination of:

a housing member having a window portion through which the time display means can be viewed and an actuator-receiving portion adjacent said window portion, said housing member also having first and second oppositely directed pivot pins extending from the sides thereof, first actuator means mounted in the actuator-receiving portion of the housing and connected to control selected functions of the timepiece, second actuator means disposed in one of said pivot pins and connected to control other selected functions of the timepiece, a multifunctional member having first and second leg members mounted at their ends on the first and second pivot pins respectively, said leg members defining therebetween an open portion and connected at their ends to a cover portion, said member being pivotable to a first position in front of the housing such that said cover portion overlies the first actuating means to prevent inadvertent actuation while the open portion permits viewing the display, and pivotable to a second position behind the housing such that said member functions as a stand for supporting the timepiece, and means for adjusting the pivot friction to provide for various selected angles in the second position.

* * * * *